US007316274B2

(12) United States Patent
Xu et al.

(10) Patent No.: US 7,316,274 B2
(45) Date of Patent: Jan. 8, 2008

(54) ONE TRIP PERFORATING, CEMENTING, AND SAND MANAGEMENT APPARATUS AND METHOD

(75) Inventors: Yang Xu, Houston, TX (US); Bennett Richard, Kingwood, TX (US); Christian Bayne, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 181 days.

(21) Appl. No.: 11/068,941

(22) Filed: Feb. 28, 2005

(65) Prior Publication Data

US 2005/0194143 A1 Sep. 8, 2005

Related U.S. Application Data

(60) Provisional application No. 60/550,686, filed on Mar. 5, 2004.

(51) Int. Cl.
*E21B 33/10* (2006.01)
*E21B 33/13* (2006.01)

(52) U.S. Cl. ..... 166/285; 166/386; 166/387; 166/382; 166/208; 166/212

(58) Field of Classification Search ..... 166/285, 166/297, 298, 386, 387, 382, 177.4, 208, 166/212, 55.1
See application file for complete search history.

(56) References Cited

U.S. PATENT DOCUMENTS

| | | | |
|---|---|---|---|
| 2,855,049 | A | 10/1958 | Zandmer |
| 2,913,052 | A | 11/1959 | Harmon |
| 3,224,506 | A | 12/1965 | Huitt et al. |
| 3,245,472 | A | 4/1966 | Zandmer |
| 3,301,337 | A | 1/1967 | Vaughn et al. |
| 3,347,317 | A | 10/1967 | Zandmer |
| 3,390,724 | A | 7/1968 | Caldwell |
| 3,425,491 | A | 2/1969 | Zandmer |
| 4,285,398 | A | 8/1981 | Zandmer et al. |
| 4,750,571 | A | 6/1988 | Geeting |
| 4,825,944 | A | 5/1989 | Mays et al. |
| 5,165,478 | A | 11/1992 | Wilson |
| 5,228,518 | A | 7/1993 | Wilson et al. |
| 5,425,424 | A | 6/1995 | Reinhardt et al. |
| 5,445,220 | A | 8/1995 | Gurevich et al. |

(Continued)

FOREIGN PATENT DOCUMENTS

| | | |
|---|---|---|
| GB | 2277337 | 10/1994 |

(Continued)

OTHER PUBLICATIONS

Fuller, M.S., et al.; Innovative Way to Cement a Liner Utilizing a New Inner String Liner Cementing Process: Paper presented at 1998 IADC/SPE Drilling Conference; Mar. 3-6, 1998; Dallas, Texas; pp. 501-504.

*Primary Examiner*—David Bagnell
*Assistant Examiner*—Robert Fuller
(74) *Attorney, Agent, or Firm*—Darin H. Duphome; Baker Hughes Incorporated

(57) ABSTRACT

A method and apparatus for running a liner into a well bore, hanging the liner to a casing, perforating the liner, cementing the liner in, setting a liner packer, and establishing sand control, all in one trip.

21 Claims, 10 Drawing Sheets

U.S. PATENT DOCUMENTS

| | | | | |
|---|---|---|---|---|
| 5,632,348 | A | 5/1997 | Yunan | |
| 5,823,254 | A | 10/1998 | Dobson et al. | |
| 5,829,520 | A | 11/1998 | Johnson | |
| 5,884,702 | A | 3/1999 | Yokley et al. | |
| 5,947,200 | A | 9/1999 | Montgomery | |
| 6,006,838 | A | 12/1999 | Whiteley et al. | |
| 6,009,947 | A | 1/2000 | Wilson et al. | |
| 6,408,945 | B1 | 6/2002 | Telfer | |
| 6,732,806 | B2 | 5/2004 | Mauldin et al. | |
| 6,766,858 | B2 | 7/2004 | Nguyen et al. | |
| 6,799,645 | B2 | 10/2004 | Mason et al. | |
| 2003/0136562 | A1 | 7/2003 | Robison et al. | |
| 2004/0129419 | A1 * | 7/2004 | Van Wulfften | 166/278 |
| 2005/0217847 | A1 * | 10/2005 | Jones | 166/278 |

FOREIGN PATENT DOCUMENTS

| | | |
|---|---|---|
| WO | WO 03/052238 | 6/2003 |
| WO | WO 03/104611 | 12/2003 |

* cited by examiner

ONE TRIP PERFORATING, CEMENTING, AND SAND MANAGEMENT APPARATUS AND METHOD

CROSS REFERENCE TO RELATED APPLICATIONS

This application relies upon U.S. Provisional Patent Application No. 60/550,686, filed on Mar. 5, 2004, and entitled "One Trip Perforating, Cementing, and Sand Management Apparatus and Method."

STATEMENT REGARDING FEDERALLY SPONSORED RESEARCH OR DEVELOPMENT

Not Applicable

BACKGROUND OF THE INVENTION

1. Field of the Invention

This invention is in the field of methods and apparatus used for cementing a liner in a well bore in an oil or gas well, and for subsequently performing other operations such as injecting into the well or producing hydrocarbons from the well.

2. Background Art

In the drilling and completion of oil and gas wells, it is common to position a liner in the well bore, to cement the liner in place, to perforate the liner, and to gravel pack the well bore, to allow the sand free production of hydrocarbons from the well or the injection of fluids into the well. These operations are typically performed in several steps, requiring multiple trips into and out of the well bore with the work string. As rig time is expensive, it would be advantageous to be able to perform all of these operations with a single trip into the well bore.

BRIEF SUMMARY OF THE INVENTION

The present invention provides a method and apparatus for running a combination tool into the well bore, including a liner with a hanger and packer, a perforation assembly, a landing assembly and float valve, and a setting assembly for installing the liner and cementing it in place. The setting assembly includes a liner hanger setting tool, a slip and button assembly, a swab cup assembly, and a gauge ring. The liner hanger, packer, perforation assembly, landing assembly, and float valve are all suspended from the liner hanger setting tool for lowering into the well bore. The perforation assembly can be any type of assembly adapted to provide access between the inner bore of the tool and the formation, either by the extension of telescoping perforation elements, or by the perforation of the cement layer in the annulus as is known in the art.

When the liner is at the desired depth, the flow through the landing assembly and the float valve is hydraulically shut off, and fluid pressure is used to set the liner hanger to suspend the entire assembly from the casing. Then, the setting assembly is hydraulically released from the liner hanger. If a telescoping perforation assembly is used, fluid pressure is used to extend the telescoping elements in the perforation section to contact the formation. Subsequently, fluid pressure shears a bull plug loose to re-establish flow through the float valve. Then, a stinger on the bottom of the setting assembly is landed in the landing assembly, at which time the gauge ring also completely extends any telescoping perforation elements which may not have fully extended under fluid pressure.

Cement is pumped through the landing assembly, out through the float valve, and up into the annulus between the liner and the formation. Where used, the telescoping elements preserve a plurality of fluid flow paths from the inner bore of the assembly to the formation, through the cement. Otherwise, the cemented annulus is perforated by known methods after setting of the cement. Pumpable darts below and above the cement can be used to segregate the cement from other fluids. The lower dart can shift an element in the landing assembly to establish cement flow around the dart, while the upper dart can close off the flow path which was established by the lower dart. Alternatively, instead of the fluid actuated landing collar, a standard drop-in-ball type landing collar can be used.

After the float valve is properly seated, the setting assembly can be lifted from the landing assembly, allowing packer setting dogs to extend outwardly over the top end of the liner packer assembly. Setting the setting assembly down on the top end of the packer assembly sets the packer to seal the annulus between the liner and the casing.

The novel features of this invention, as well as the invention itself, will be best understood from the attached drawings, taken along with the following description, in which similar reference characters refer to similar parts, and in which:

DETAILED DESCRIPTION OF THE INVENTION

Figures 1A, 1B:
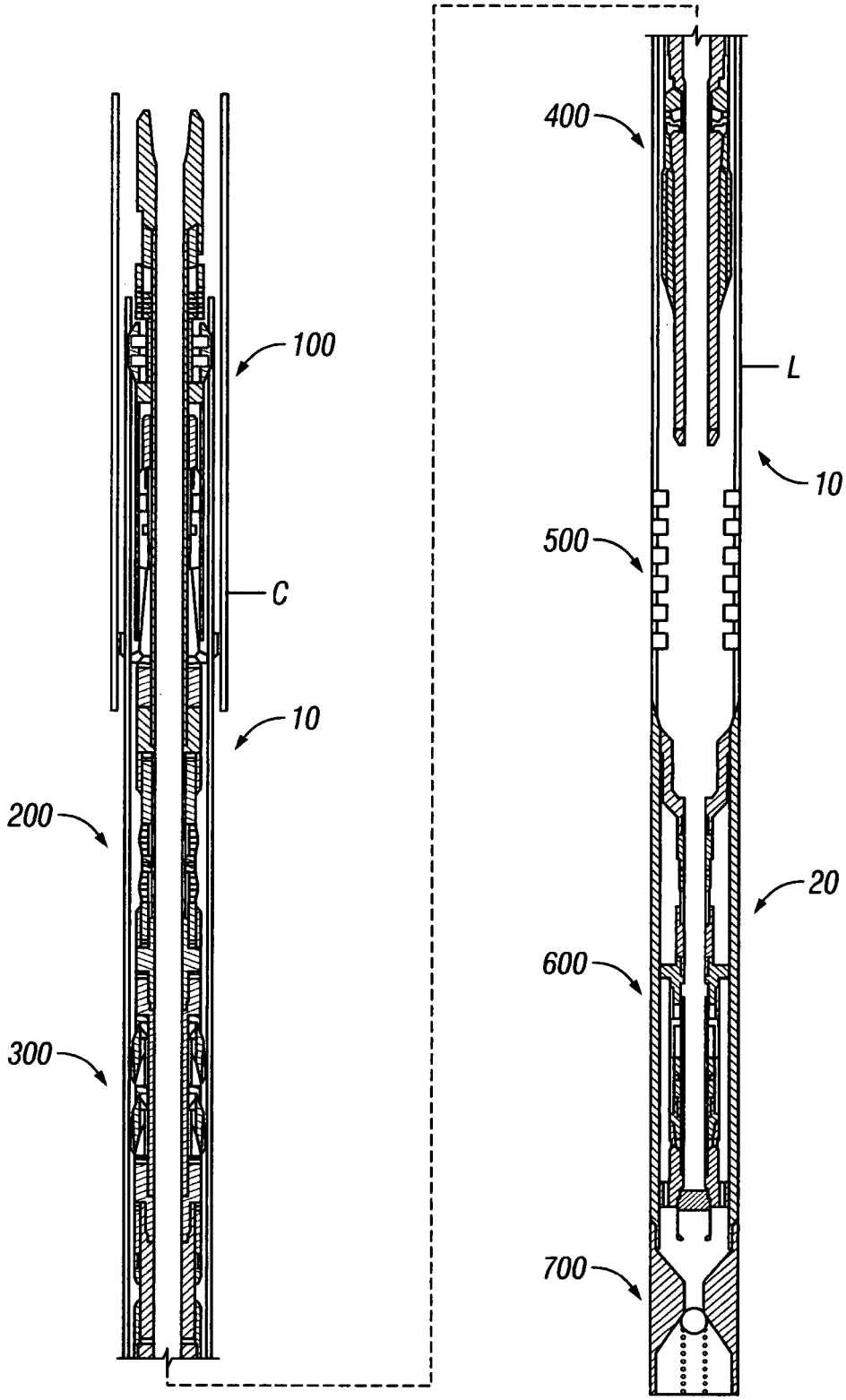
FIGS. 1A and 1B are a section view of the apparatus of the present invention.

As shown in FIGS. 1A and 1B, the apparatus of the present invention includes a setting assembly 10 and a landing assembly 20. A liner L is suspended from the setting assembly 10 by a liner hanger, with a perforation assembly 500 and the landing assembly 20 attached at the bottom of the liner L. Instead of the perforation assembly 500, discussed in more detail below, another type of perforation tool, known in the art, can be used. The entire apparatus, including the liner L, is lowered through the casing C into the well bore.

The setting assembly 10 includes a liner hanger setting subassembly 100, a slip and button subassembly 200, a seal cup subassembly 300, and a liner packer setting subassembly 400. The landing assembly 20 includes a landing collar subassembly 600 and the float valve 700. The liner hanger and liner packer, as commonly known in the art, are shown only symbolically in FIG. 1A, between the liner L and the casing C. This apparatus is designed to lower the liner L into the well bore through the casing C, hang the liner L from the casing C with the liner hanger, release the setting assembly 10 from the liner hanger, lower the setting assembly 10 into the landing assembly 20, pump cement into the annulus between the liner L and the formation, set the liner packer to seal the annulus between the liner L and the casing C, and withdraw the setting assembly from the well, all in one trip. Where a telescoping perforation assembly is used, the perforation elements are extended into contact with the formation before the cement is pumped. Otherwise, the cement layer is perforated by known methods after the cement sets.

Figure 2:
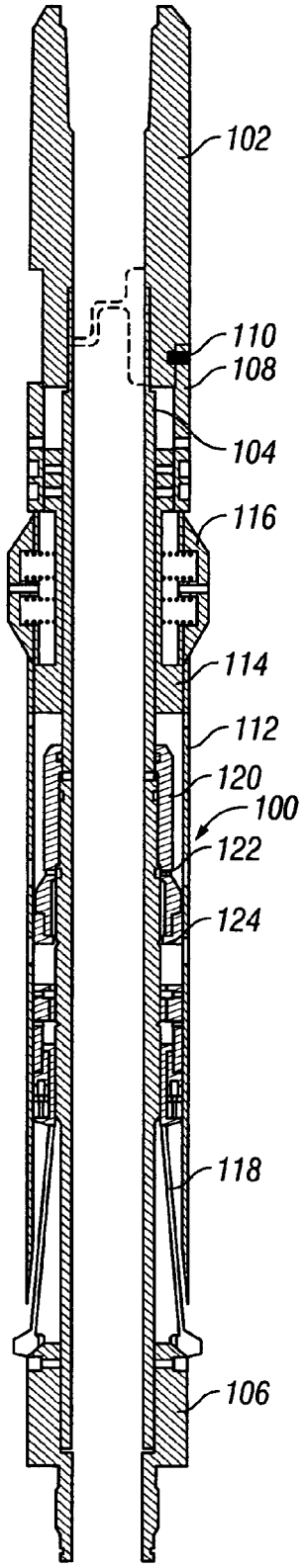
FIG. 2 is a section view of the liner hanger setting subassembly of the apparatus of FIG. 1A.

As shown in FIG. 2, the liner hanger setting subassembly 100 includes a top connector 102 connected to a mandrel 104 with threads and one or more set screws. The mandrel 104 is in turn threadedly connected to a bottom connector 106. A cylindrical torque finger holder 108 is attached to the outer surface of the top connector 102 by one or more shear screws 110. The top end of the torque finger holder 108 has a serpentine profile as represented by the lower dashed line, and the outer surface of the top connector 102 has a similar profile, represented by the upper dashed line, designed to interlock with the serpentine profile on the top of the torque finger holder 108, to transfer torque in the clockwise direction. The profiles on the top end of the torque finger holder 108 and on the outer surface of the top connector 102 are designed not to transfer torque in the counter-clockwise direction, thereby allowing selective shearing of the shear screw 110 as will be discussed below.

A hollow cylindrical collet housing 112 is suspended below the top connector 102. The lower end of a cylindrical torque finger retainer 114 is attached to the inner surface of the collet housing 112 by splines and one or more set screws, and the upper end of the torque finger retainer 114 is bolted to the torque finger holder 108. A plurality of outwardly biased torque fingers 116 are positioned in slots in the torque finger retainer 114. The torque fingers 116 are biased outwardly into longitudinal slots in the inner surface of the liner hanger, as shown in FIG. 1A. The torque fingers 116 and the aforementioned apparatus shearably connecting them to the top connector 102 are provided for the purpose of accomplishing an emergency release of the setting assembly 10 from the liner hanger, as will be described below. An outwardly biased collet 118 is attached to the collet mandrel 104, by means of a collet piston 120 which is attached to the mandrel 104 by one or more collet piston shear screws 122, and by means of one or more collet shear screws 124. Interconnecting structure between the collet 118, the collet piston 120, and the mandrel 104 is described in more detail below.

Figure 3:
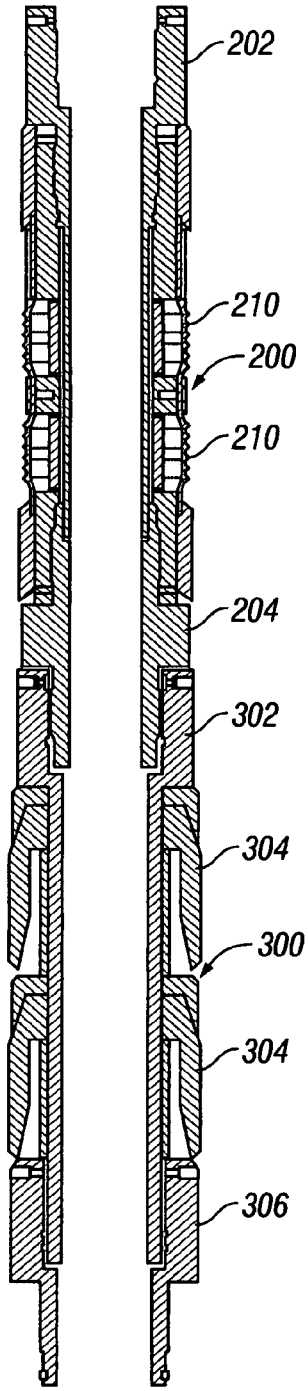
FIG. 3 is a section view of the hold down button and swab cup subassemblies of the apparatus of FIG. 1A.

As shown in FIG. 3, the slip and button subassembly 200 includes a slip mandrel 202 which is threadedly attached to a bottom sub 204. A plurality of outwardly biased slips 210 are positioned around the outer surface of the slip and button subassembly 200, to provide longitudinal positioning of the setting assembly 10 relative to the liner L. Attached to the bottom sub 204 of the slip subassembly 200 is the upper end of a seal cup mandrel 302 of the seal cup subassembly 300. The lower end of the seal cup mandrel 302 is threadedly attached to a seal cup bottom sub 306. A plurality of seal cups 304 are positioned around the outer surface of the seal cup subassembly 300, to provide a pressure seal against fluid pressure below the seal cup subassembly 300, in the annulus between the setting assembly 300 and the liner L.

Figure 4:
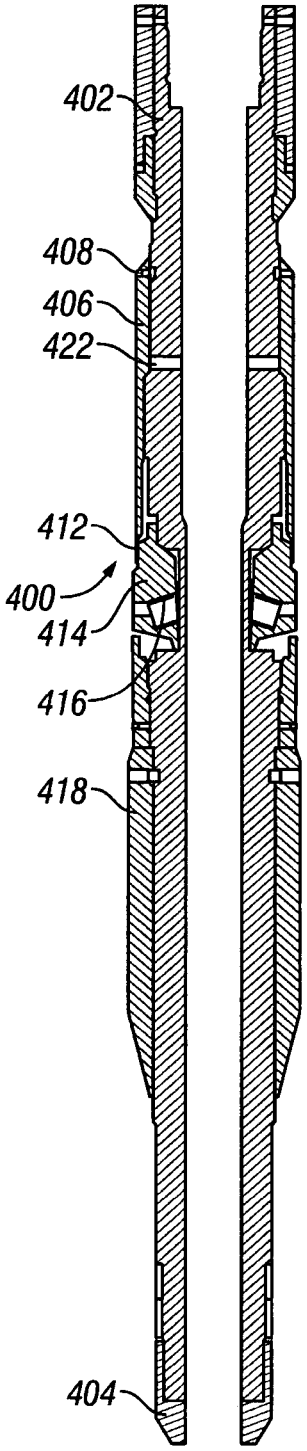
FIG. 4 is a section view of the liner packer setting subassembly and gauge ring shown in FIGS. 1A and 1B.

As shown in FIG. 4, the liner packer setting subassembly 400 includes a packer setter body 402, with a bottom sub 404 at its lower end. A cylindrical setting dog keeper 406 is shearably attached to the body 402 by one or more keeper shear screws 408. A setting dog keeper skirt 412 is formed at the lower end of the dog keeper 406, surrounding a plurality of packer setting dogs 414. The packer setting dogs 414 are outwardly biased by a plurality of dog springs 416, but they are held inwardly against the body 402 by the dog keeper skirt 412 when the dog keeper 406 is pinned in its lower position as shown. One or more packer setter ports 422 are provided through the wall of the body 402 from its inner bore to its outer surface, communicating fluid pressure to a chamber between the outer surface of the body 402 and the inner surface of the setting dog keeper 406. A gauge ring 418 is mounted on the body 402 below the packer setting dogs 414, and attached thereto with one or more shear screws. The outer diameter of the gauge ring 418 is only slightly smaller than the full inner diameter of the liner L. If the gauge ring 418 hangs up at any point in the process, the tool can be pulled free by shearing the shear screws.

Figure 5:
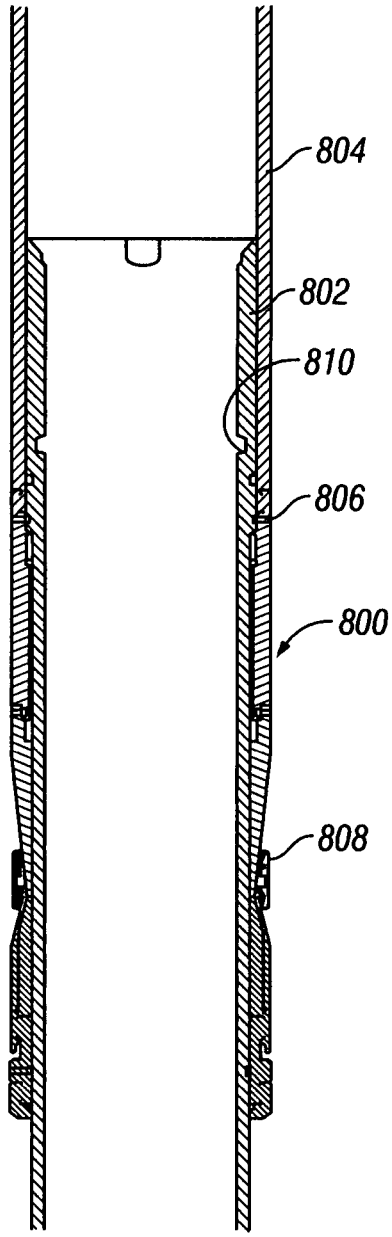
FIG. 5 is a section view of a liner packer assembly which can be used with the present invention.

A typical liner packer 800 is shown in FIG. 5, with a packer body 802, and a setting mandrel 804 which is attached to the packer body 802 with one or more shear screws 806. An expandable packer element 808 is provided around the outer surface of the packer 800. A liner support profile 810 is provided on the inner surface of the packer body 802. The collet 118 on the liner hanger setting subassembly 100 is outwardly biased into the liner support profile 810. This supports the liner L from the liner hanger setting subassembly 100 by creating an interference fit, with the collet 118 being forced firmly into the liner support profile 810 by the weight of the liner L and a reactive upward force of a tapered upper surface on the bottom connector 106 of the liner hanger setting subassembly 100.

Figure 6:
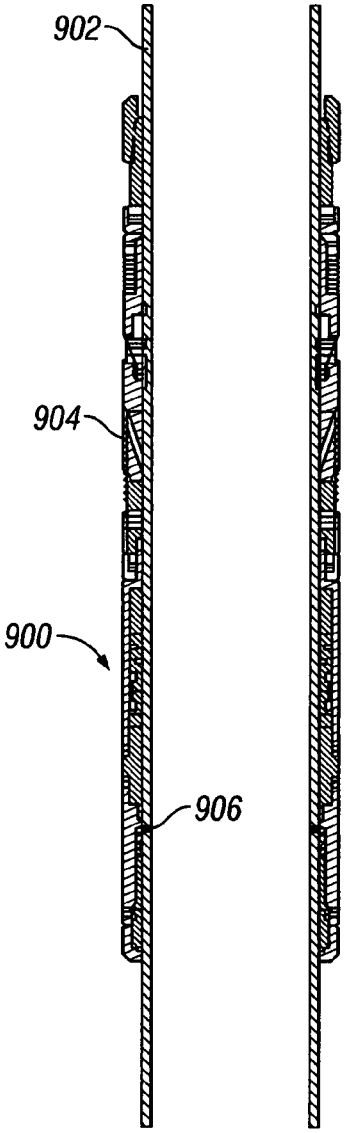
FIG. 6 is a section view of a liner hanger assembly which can be used with the present invention.

As shown in FIG. 6, a typical liner hanger 900 is suspended below the packer 800, including a hanger body 902, a plurality of hanger slips 904, and one or more hanger setting ports 906, through the wall of the hanger body 902. As is commonly known in the art, this type of liner hanger is set by applying sufficient fluid pressure through the ports 906 to shift one or more sleeves on the hanger 900 to wedge the slips 904 outwardly and downwardly against the inner surface of a casing. After the hanger 900 is set, the weight of the liner L applies additional outward force against the slips 904, wedging them more tightly against the casing C.

Figure 7:
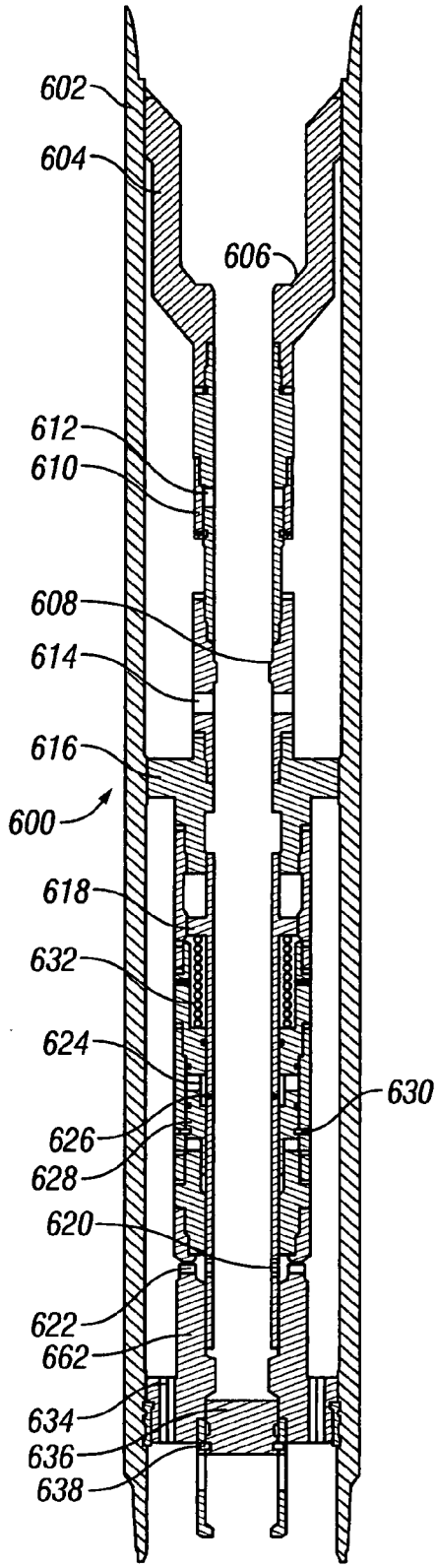
FIG. 7 is a section view of the landing assembly shown in FIG. 1B.

As shown in FIG. 7, the landing collar subassembly 600 includes a landing collar body 602 which is attached below the telescoping perforation assembly 500, which is discussed in more detail below. A liner section having a slightly increased inner diameter is provided between the perforation assembly 500 and the landing collar subassembly 600. A stinger seat 604 is fixedly mounted to the inner bore of the landing collar body 602, with a stinger seating profile 606 on its inner surface. Below the stinger seat 604, a reduced diameter in the bore provides a dart seat 608. At least one upper bypass port 612 above the dart seat 608, and at least one lower bypass port 614 below the dart seat 608, are provided from the inner bore to the annulus within the landing collar body 602. A cylindrical indicating ring 610 is slidingly positioned to cover the upper bypass ports 612, and held in place by one or more shear screws.

Figure 8:
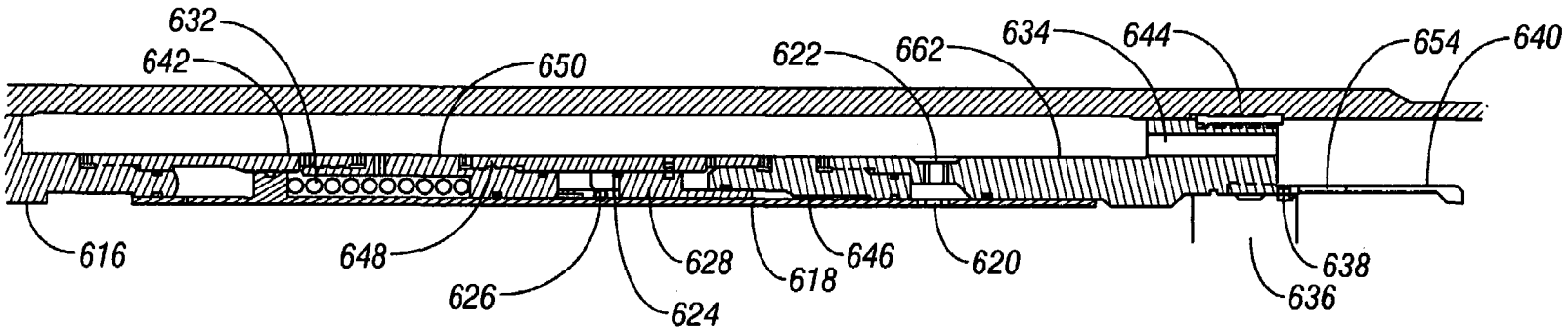
FIGS. 8 and 9 are section views of a portion of the landing assembly, showing the hydraulic shut-off operation.

As seen in FIGS. 7 and 8, a middle connector 616 essentially isolates the upper annulus within the landing collar body 602 from the lower annulus. A shifting mandrel 618 is slidingly positioned to contact the inner surface of the lower end of the middle connector 616 and to extend down through the main bore of the landing collar subassembly 600. Near the lower end of the shifting mandrel 618, one or more flow ports 620 are provided through the wall of the shifting mandrel 618. One or more orifices 622 are provided in fluid flow communication with the flow ports 620, to allow fluid to flow from the main bore, through the flow ports 620, through the orifices 622, and through a plurality of longitudinal flow channels 634 in the orifice housing 662, to exit the lower end of the landing collar subassembly 600. The orifice housing 662 is held in place in the landing collar body 602 by a lock ring 644.

The outer surface of the lower end of the middle connector 616 has mounted thereto an upper housing 642, to which is connected a spring housing 650, and a piston housing 648 therebelow. A seal sub 646 is connected to the lower end of the piston housing 648, and the orifice housing 662 is connected to the seal sub 646. A piston 628 is positioned between the piston housing 648 and the mandrel 618, with the piston 628 being shearably pinned to the piston housing 648 by one or more shear screws 630. A mandrel spring 632 is positioned between the spring housing 650 and the mandrel 618, biasing the mandrel 618 upwardly.

The mandrel 618 is held in place in its lower position, shown in FIG. 8, by one or more balls 626 and a ball retainer 624, interacting with the piston 628. The ball 626 sits in a groove in the outer surface of the mandrel 618 and in a hole in the ball retainer 624. A shoulder on the top end of the piston 628 extends over the ball retainer 624 and holds the ball 626 down in the groove in the mandrel 618. The upper end of the ball retainer 624 is biased against the lower end of the spring housing 650, preventing the ball retainer 624, the ball 626, and the mandrel 618 from moving upwardly. As will be discussed further below, a shifting port 652 is provided through the mandrel 618, from the main bore to a chamber within the piston housing 648 above the piston 628.

Below the mandrel 618, a bull plug 636 is retained in place by one or more shear screws 638, blocking the main bore. Below the bull plug 636 is a bull plug catcher 640, with one or more main flow ports 654 therethrough.

Figure 9:
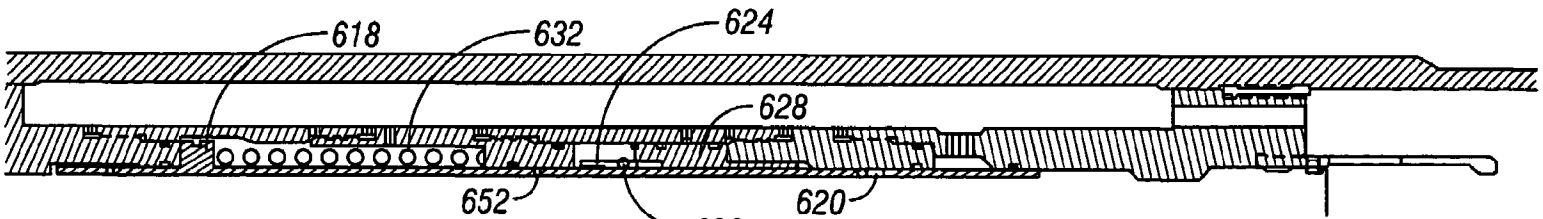

The apparatus is assembled and lowered into the well bore, until the landing collar subassembly 600 and the perforation assembly 500 are at the desired depths. Then, as shown in FIG. 9, the fluid flow rate through the apparatus is increased, until backpressure created by the orifices 622 exerts enough pressure through the shifting port 652 to shear the piston shear screw 630 and drive the piston 628 down against the seal sub 646. This allows the ball 626 to come out of the groove in the mandrel 618, releasing the mandrel 618. Bleeding off pressure then allows the mandrel spring 632 to drive the mandrel 618 upwardly, blocking off flow through the orifices 622. An increasing pressure alerts the operator that the mandrel 618 has shifted. Alternatively, a standard drop-in-ball type landing collar could be used, instead of the illustrated fluid actuated landing collar.

As pressure increases, hydrostatic force via the hanger port 906 sets the liner hanger 900 to support the weight of the liner L from the casing C. Weight is set down with the work string to compensate for upward hydraulic force on the setting tool, until the collet 118 is essentially free from the weight of the liner L. The slip and button subassembly 200 assists in counteracting this upward hydraulic force.

Figure 10:
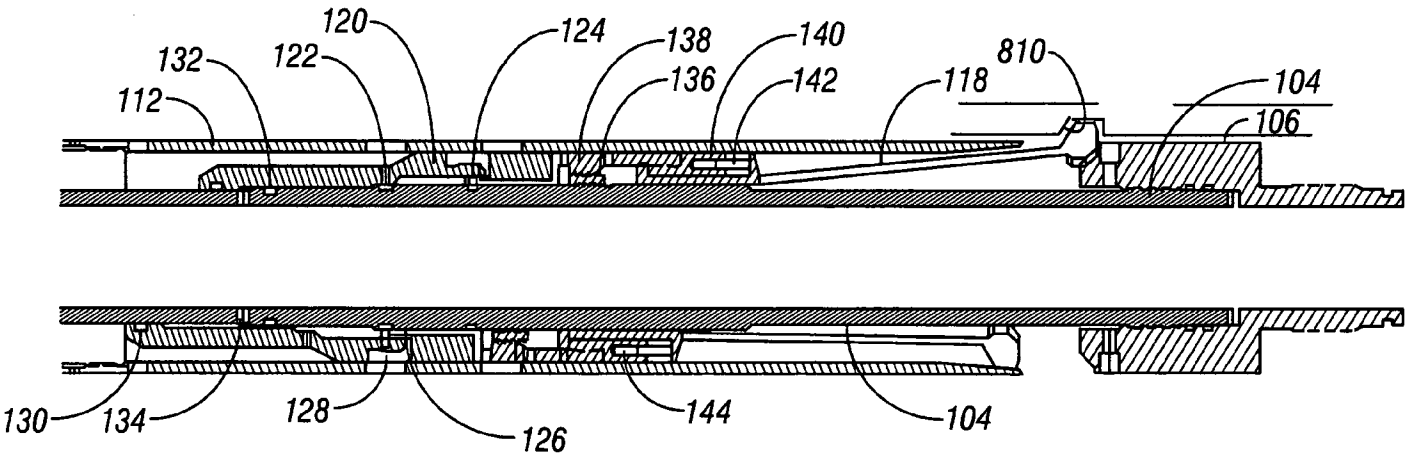
FIG. 10 is a two position section view of a portion of the liner hanger setting subassembly, showing the hydraulic release operation.

The portion of FIG. 10 above the centerline of the tool shows the tool in this weight-neutral condition. The collet 118 is still extending into the profile 810 in the liner, but the liner is not exerting weight on the collet 118, or on the bottom connector 106. Slack in movement of the collet 118 is absorbed by a collet spring 144 on a collet spring guide 142. It can be seen in this Figure that the upper end of the collet 118 engages a split ring 140 and a collet retainer 138. The upper end of the collet retainer 138 engages the lower end of the collet piston 120, by means of a snap ring 126 and a snap ring retainer 128. As mentioned before, the collet piston 120 is held in place up to this point by one or more shear screws 122, 124.

After the liner hanger is set and the collet 118 is weight-neutral, pressure is further increased through a mandrel port 134 until hydrostatic pressure between a piston seal 130 and a mandrel seal 132 is sufficient to shear the shear screws 122, 124. This drives the collet piston 120 upwardly, pulling with it the collet 118, until the collet 118 pulls out of the liner profile 810 and up within the collet housing 112, as shown in the portion of FIG. 10 below the tool centerline. This releases the liner from the liner hanger setting subassembly 100. A body lock ring 136 between the collet retainer 138 and the collet mandrel 104 holds the collet 118 in this position within the collet housing 112.

Figure 11:
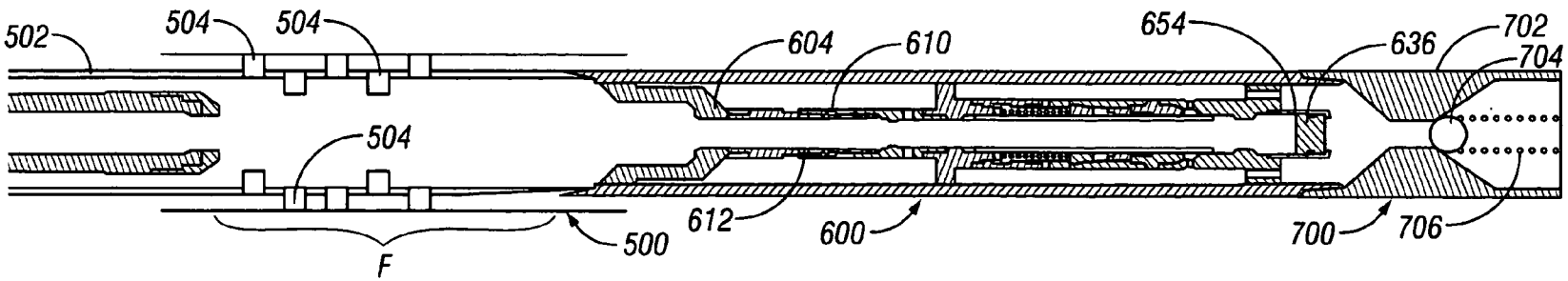
FIG. 11 is a section view of the landing assembly, showing hydraulic extension of the perforation elements and re-establishment of the main bore flow.

Then, fluid pressure is further increased until the bull plug shear screws 638 are sheared, releasing the bull plug 636 to drop down into the bull plug catcher 640, as shown in FIG. 11. This opens up flow through the main bore, through the main flow ports 654, and out through the float valve 700, by displacing the float valve ball 704 against the bias of the float valve spring 706 which tends to seat the ball 704 against the housing 702. In the condition shown in FIG. 11, flow out the float valve 700 passes into the annulus and back up around the liner L.

Where a telescoping perforation assembly 500 is used, this increase in pressure also causes some or all of the telescoping perforation elements 504 on the perforation assembly 500 to extend to contact the formation F. Similar telescoping perforation elements are disclosed in U.S. Pat. No. 5,829,520, which is hereby incorporated herein by reference.

Figure 20:
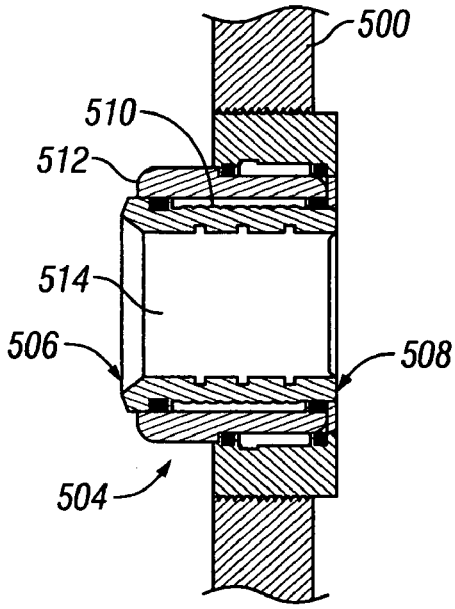
FIG. 20 is a section view of one embodiment of a telescoping perforation element which can be used with the present invention, shown in the retracted condition.
Figure 21:
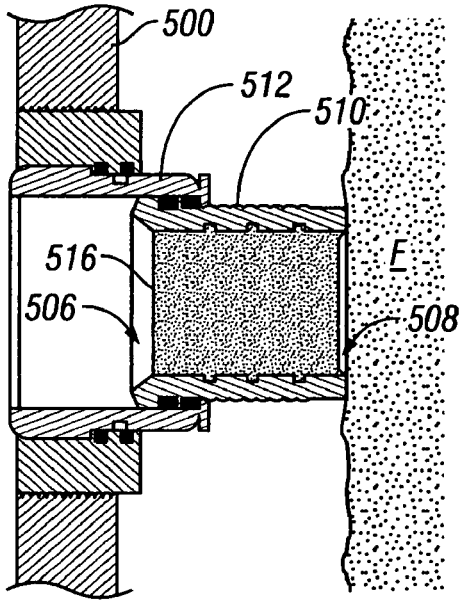
FIG. 21 is a section view of the perforation element of FIG. 20, shown in the extended condition.

FIG. 20 shows one embodiment of such a telescoping perforation element 504 in the refracted position, while FIG. 21 shows the telescoping perforation element 504 in the extended position. The element 504 can have one, two, or more tubular extensions 510, 512, arranged in a telescoping fashion. The innermost end 506 of these extensions protrudes radially inwardly into the inner bore of the perforation assembly 500, with the outermost end 508 of the extensions oriented radially outwardly. The interior 514 of the innermost extension provides a flow path for fluids. As seen in FIG. 21, when the element 504 is fully extended, the outermost end 508 contacts the surface of the formation F. As also shown in FIG. 21, the interior 514 of the element 504 can be filled with a sand control medium 516, as disclosed, for example, in U.S. Pat. No. 5,829,520. Further, the sand control medium 516 can be retained in place as disclosed in U.S. Pat. No. 5,829,520. Or, the sand control medium can be retained within the element 504 by screens placed generally at the inner surface 506 and the outer surface 508. The spaces between the sand control medium can be filled with a selectively removable blocking medium, as disclosed in U.S. Pat. No. 5,829,520.

Figure 12:
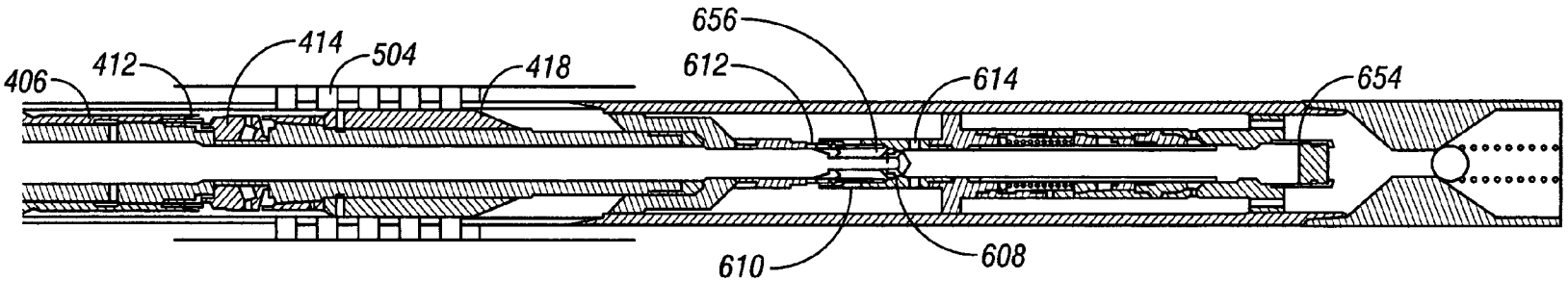
FIG. 12 is a section view of the landing assembly and the liner packer setting subassembly, showing mechanical extension of the perforation elements and initiation of cement flow.

After flow is established through the float valve 700, the work string is picked up to make sure that the liner hanger setting subassembly 100 has released from the liner hanger. If it has not, the emergency release procedure is employed, as discussed below. If the hanger has released, the setting assembly 10 is lowered into the liner until the stinger or bottom sub 404 of the liner packer setting subassembly 400 is landed in the stinger seating profile 606 of the stinger seat 604 of the landing collar subassembly 600, as shown in FIG. 12. As the setting assembly 10 is lowered, the torque transfer fingers 116 deflect inwardly against their biasing elements, collapsing the torque fingers 116 to the GD of the setting assembly 10, thereby allowing the torque transfer fingers 116 to exit the longitudinal slots in the inner surface of the liner. During the lowering of the setting assembly 10, the gauge ring 418 will mechanically extend any of the telescoping perforators 504 that did not fully extend hydraulically. The increased diameter of the liner section between the perforation assembly 500 and the landing collar subassembly 600 prevents fluid pressure under the seal cups from interfering with the seating of the stinger.

Figure 13:
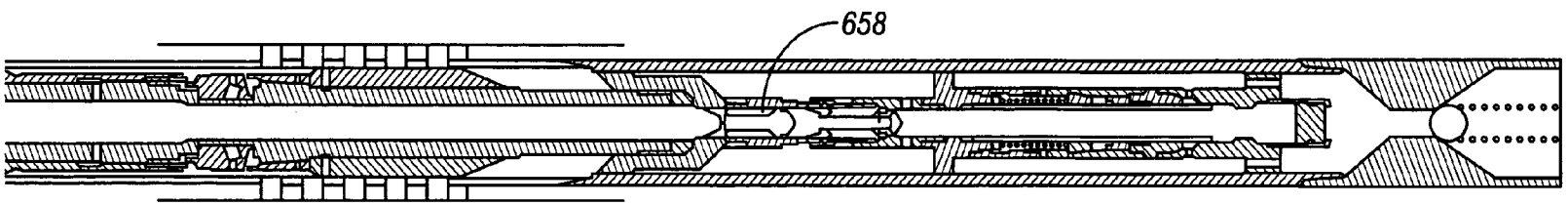
FIG. 13 is a section view of the landing assembly and the liner packer setting subassembly, showing completion of cement flow.
Figure 14:
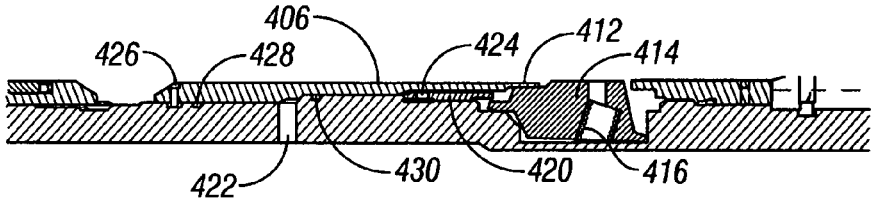
FIGS. 14 and 15 are detailed section views of a portion of the liner packer setting subassembly, showing extension of the setting dogs.
Figure 15:
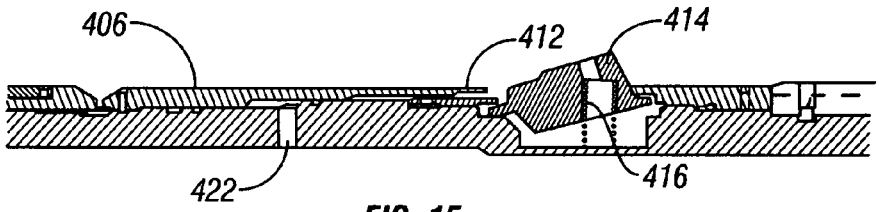

The cement is then pumped into the work string, with a pumpable dart 656 in front of, or below, the cement. A second pumpable dart 658 can also be pumped behind, or above, the cement, as shown in FIG. 13. When the lower dart 656 has landed in the dart seat 608, as shown in FIG. 12, pressure is increased to release the liner hanger setting dogs 414. As shown in more detail in FIG. 14, the setting dogs 414 are held in place by a top holding ring 420 and set screw 424. The setting dogs 414 are held inwardly, against the bias of the dog springs 416, by the skirt 412 on the lower end of the dog keeper 406. The dog keeper 406 is held in place by one or more shear screws 426. As shown in FIG. 15, as pressure increases between an upper o-ring 428 and a lower o-ring 430, through the packer setter port 422, the keeper shear screws 426 are sheared. This allows the dog keeper 406 to be forced upwardly by the hydrostatic pressure, until the keeper skirt 412 pulls away from the dogs 414, allowing the dog keeper springs 416 to push the dogs 414 outwardly. Since, at this point, the packer setting subassembly 400 is still within the liner L, the dogs 414 will move out against the inner surface of the liner L.

Figure 16:
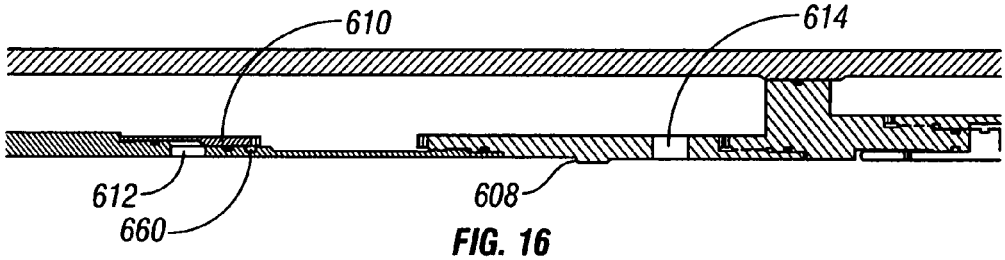
FIGS. 16 and 17 are detailed section views of a portion of the landing assembly, showing seating of the pumpable plug and establishment of bypass flow of cement.
Figure 17:
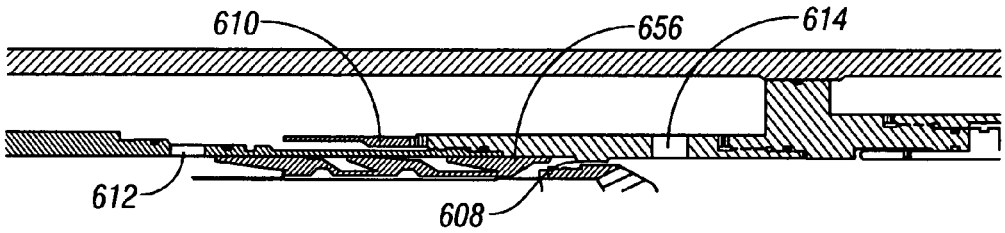

Pressure is then further increased to open the upper bypass port 612, as shown in more detail in FIGS. 16 and 17. That is, as pressure is increased on the upper bypass port 612, this pressure eventually shears the indicating ring shear screw 660, which releases the indicating ring 610 to be driven downwardly. This opens the upper dart bypass port 612 for cement flow, which passes through the annulus and back into the main bore through the lower bypass port 614, thereby bypassing the lower dart 656 and providing an indication for the operator that the dart has seated and the bypass flow of cement has been established. If the upper bypass port 612 does not open, the pressure is increased until a blow out plug in the lower dart 656 is ruptured. When the upper dart 658 has seated against the lower dart 656, this again blocks flow through the bypass ports 612, 614 or through the blow-out plug.

Figure 18:
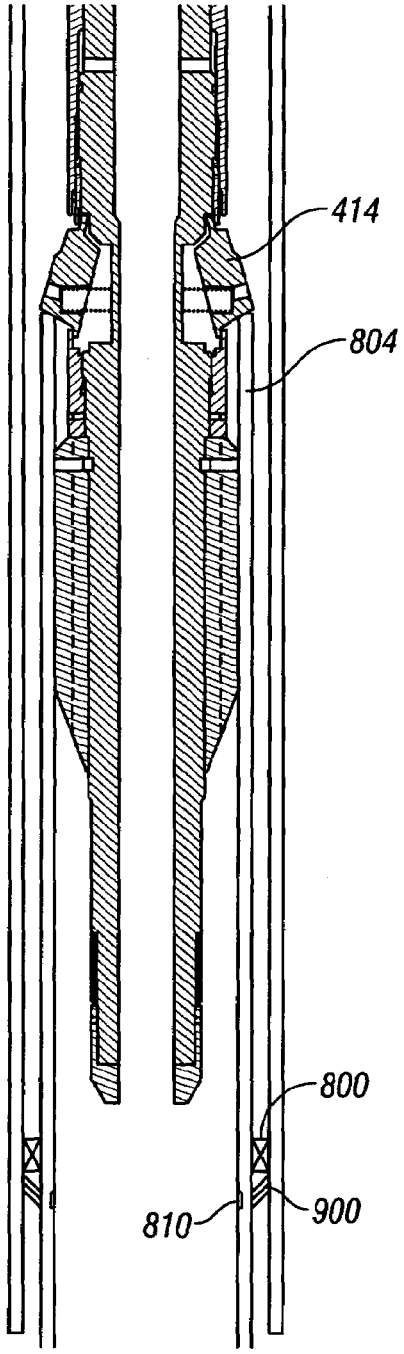
FIG. 18 is a section view of the liner packer setting subassembly, showing setting of the packer.

After completion of the cementing, the annulus surrounding the perforation assembly 500 is filled with cement, except for the flow paths provided by the telescoping perforation elements 504, where the telescoping element type of perforation assembly is used. When the cement back pressure is being held by the float valve, the setting assembly 10 is pulled upwardly, until the packer setting dogs 414 are above the upper end of the packer 800, and the dogs 414 are fully extended, as shown in FIG. 18. The setting assembly 10 is then set down on top of the liner, applying force to expand and set the packer 800, as is commonly known in the art. The tool is then pulled from the well bore. Where a telescoping element type of perforation assembly is not used, the perforation assembly is used to perforate the liner and the cement, as is known in the art, after the cement sets.

Figure 19:
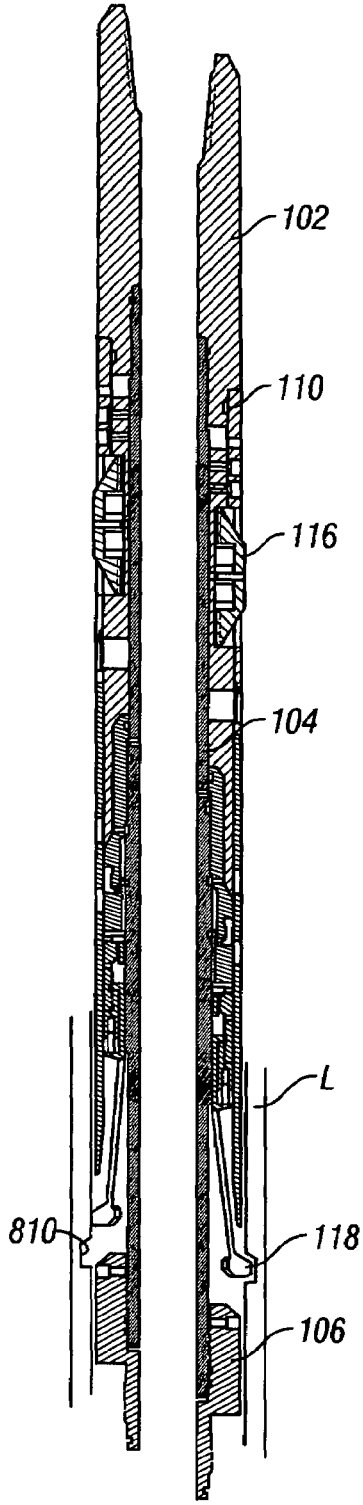
FIG. 19 is a two position section view of the liner hanger setting subassembly, showing emergency release of the setting assembly from the liner hanger.

As mentioned above, if the collet 118 fails to release from the liner profile 810, the emergency release procedure is used. This is illustrated in FIG. 19, where the portion of the tool to the right of the centerline illustrates the emergency released position, and the portion to the left of the centerline illustrates the tool when the work string has been pulled upwardly to mechanically pull the collet 118 out of the liner profile 810. The torque fingers 116 ride in longitudinal slots in the liner. Rotating the work string counterclockwise shears the shear screw 110, allowing the top connector 102 to drop down relative to the liner, as shown in the right hand portion of FIG. 19. This moves the bottom connector 106 out of contact with the collet 118. At the same time, the mandrel 104 is moved downwardly relative to the collet 118, and the collet 118 is held in this new position on the mandrel 104 by the body lock ring 136, shown in FIG. 10. Then, the work string is pulled upwardly, pulling the collet 118 out of the liner profile 810, as shown in the left hand portion of FIG. 19. Thereafter, the setting assembly 10 is pulled from the well bore and the liner packer setting subassembly 400 is made up on the work string. The tool is then lowered to land the stinger in the landing collar subassembly 600, pump cement, and set the packer, as discussed above.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A method for installing a perforated liner in a well bore, and cementing the liner in place, in a single trip, said method comprising:

providing a setting assembly attached to a drill string and a liner suspended from said setting assembly by a liner hanger, said liner having a perforation assembly and a landing assembly below said setting assembly;

lowering said setting assembly and said liner into a well bore;

selectively establishing and stopping fluid flow through said landing assembly;

expanding said liner hanger against the well casing to support said liner from said casing;

releasing said setting assembly from said liner hanger;

re-establishing flow through said landing assembly;

lowering said setting assembly into seating contact with said landing assembly;

pumping cement through said setting assembly and said landing assembly into the well bore;

withdrawing said setting assembly from said landing assembly; and applying downward force with said setting assembly to expand a liner packer against the well casing.

2. The method recited in claim 1, further comprising:

providing radially extendable telescoping elements on said perforation assembly; and hydraulically extending said telescoping elements to contact said formation by raising fluid pressure.

3. The method recited in claim 1, further comprising:

providing a liner hanger setting subassembly as part of said setting assembly;

suspending said liner hanger from said liner hanger setting subassembly during run-in; and hydraulically shifting an element of said liner hanger setting subassembly to release said liner hanger from said liner hanger setting subassembly.

4. The method recited in claim 3, further comprising:

providing an outwardly biased collet shearably attached to said liner hanger setting subassembly, said collet establishing an interference fit between said liner hanger setting subassembly and an internal profile of said liner hanger, to thereby suspend said liner hanger from said liner hanger setting subassembly; and applying hydrostatic pressure to shearably release said collet from said liner hanger setting subassembly and to hydraulically shift said collet to withdraw said collet from said internal profile of said liner hanger, thereby releasing said setting assembly from said liner hanger.

5. The method recited in claim 4, further comprising:

providing an emergency release mechanism on said liner hanger setting subassembly, said emergency release mechanism comprising a torque transfer element, an emergency shearable element, and a longitudinal shifting element; and in the event of failure of said shearably releasing and hydraulically shifting of said collet, applying torque via said drill string, said torque being transferred to the liner by said torque transfer element, thereby shearing said emergency shearable element, and thereby allowing longitudinal shifting of said longitudinal shifting element to allow said liner hanger setting subassembly to drop relative to said liner, thereby shearably releasing said collet from said liner hanger setting subassembly; and lifting with said drill string to mechanically withdraw said collet from said internal profile of said liner hanger, thereby releasing said setting assembly from said liner hanger.

6. The method recited in claim 1, further comprising:

providing radially extendable telescoping elements on said perforation assembly;

providing a gauge ring on said setting assembly; and mechanically extending said telescoping elements to contact said formation by lowering said gauge ring through said perforation assembly.

7. The method recited in claim 1, further comprising:

providing a liner packer setting subassembly as part of said setting assembly; and applying compressive force to said liner packer setting subassembly with said drill string, to thereby expand said liner packer.

8. An apparatus for installing a liner in a well bore, cementing the liner in place, and setting a liner packer against the well casing, in a single trip, said apparatus comprising:

a setting assembly attachable to a drill string for lowering into a well bore;

a liner suspended from said setting assembly, said liner having a selectively settable liner hanger, a packer, and a perforation assembly; and a landing assembly on said liner, below said setting assembly;

wherein said setting assembly is adapted to selectively release from said liner hanger, to lower into and seat in said landing assembly, and to pump cement through said landing assembly into the well bore;

wherein said setting assembly is further adapted to withdraw from said landing assembly, and to apply downward force to expand said liner packer against the well casing.

9. The apparatus recited in claim 8, wherein said setting assembly comprises:

a liner hanger setting subassembly adapted to releasably support said liner hanger during run-in; and a liner packer setting subassembly adapted to selectively expand said liner packer.

10. The apparatus recited in claim 9, wherein said liner hanger setting subassembly further comprises a hydraulically shiftable element, said shiftable element being adapted to release said liner hanger from said liner hanger setting subassembly.

11. The apparatus recited in claim 9, further comprising:

an outwardly biased collet shearably attached to said liner hanger setting subassembly, said collet establishing an interference fit between said liner hanger setting subassembly and an internal profile of said liner hanger, to thereby suspend said liner hanger from said liner hanger setting subassembly; and a fluid path adapted to apply hydrostatic pressure to shearably release said collet from said liner hanger setting subassembly and to hydraulically shift said collet to withdraw said collet from said internal profile of said liner hanger, thereby releasing said liner hanger setting subassembly from said liner hanger.

12. The apparatus recited in claim 11, further comprising:

a torque transfer element establishing a torque transfer relationship between said liner hanger setting subassembly and said liner hanger;

an emergency shearable element on said liner hanger setting subassembly, said emergency shearable element being shearable by application of torque with said drill string;

a longitudinal shifting element on said liner hanger setting subassembly, said longitudinal shifting element being adapted to shift upon shearing of said emergency shearable element to allow said liner hanger setting subassembly to drop relative to said liner hanger, thereby shearably releasing said collet from said liner hanger setting subassembly; and a locking element adapted to longitudinally fix said collet relative to said liner hanger setting subassembly after said shearable release of said collet, allowing mechanical withdrawal of said collet from said internal profile of said liner hanger to release said setting assembly from said liner hanger.

13. The apparatus recited in claim 8, further comprising a plurality of extendable telescoping elements on said perforation assembly, said telescoping elements being adapted to extend radially outwardly to contact the hydrocarbon formation.

14. The apparatus recited in claim 13, wherein said telescoping elements are further adapted to extend under fluid pressure.

15. The apparatus recited in claim 13, further comprising a gauge ring on said setting assembly, said gauge ring being adapted to mechanically extend said telescoping elements to contact the hydrocarbon formation, when said setting assembly is lowered to seat in said landing assembly.

16. The apparatus recited in claim 13, further comprising a sand control medium in each of said telescoping elements.

17. The apparatus recited in claim 13, further comprising a blocking medium in each of said telescoping elements, said blocking medium being adapted to be selectively removable by application of a dissolving agent.

18. The apparatus recited in claim 8, wherein said landing assembly comprises:

a landing collar subassembly attachable to a lower end of said liner, said landing collar subassembly having a landing seat adapted to receive a lower end of said setting assembly; and a float valve attachable to a lower end of said landing collar assembly.

19. The apparatus recited in claim 18, wherein said landing collar subassembly further comprises:

an orifice for fluid flow through said landing collar subassembly to the well bore; and a flow actuated shifting mechanism adapted to selectively stop fluid flow through said orifice.

20. The apparatus recited in claim 18, wherein said landing collar subassembly further comprises:

a main bore for fluid flow; and a plug releasably retained in a blocking position in said main bore to block fluid flow through said landing collar subassembly, said plug being hydrostatically releasable from said blocking position to establish fluid flow through said landing collar subassembly.

21. The apparatus recited in claim 18, wherein said landing collar subassembly further comprises:

a dart seat adapted to receive a pumpable dart; and fluid ports arranged to allow cement following said pumpable dart to bypass said dart when said dart is seated in said dart seat.

* * * * *